US009355599B2

(12) United States Patent
Wu et al.

(10) Patent No.: US 9,355,599 B2
(45) Date of Patent: May 31, 2016

(54) AUGMENTED INFORMATION DISPLAY

(71) Applicant: 3M INNOVATIVE PROPERTIES COMPANY, St. Paul, MN (US)

(72) Inventors: Shuguang Wu, Austin, TX (US); Jun Xiao, Austin, TX (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 152 days.

(21) Appl. No.: 14/199,183

(22) Filed: Mar. 6, 2014

(65) Prior Publication Data

US 2015/0255021 A1 Sep. 10, 2015

(51) Int. Cl.
*G09G 3/32* (2006.01)
*G09G 3/34* (2006.01)

(52) U.S. Cl.
CPC ..... *G09G 3/3426* (2013.01); *G09G 3/32* (2013.01)

(58) Field of Classification Search
CPC G09G 2300/0452; G09G 3/32; G09G 3/2022
USPC ..... 345/76, 82, 83, 87, 102, 690–693
See application file for complete search history.

(56) References Cited

U.S. PATENT DOCUMENTS

| | | | |
|---|---|---|---|
| 5,012,112 | A | 4/1991 | Flint |
| 5,748,783 | A | 5/1998 | Rhoads |
| 7,001,023 | B2 | 2/2006 | Lee |
| 7,667,762 | B2 | 2/2010 | Jenkins |
| 8,139,130 | B2 | 3/2012 | Compton |
| 8,155,362 | B2 | 4/2012 | Chris |
| 8,400,548 | B2 | 3/2013 | Bilbrey |
| 8,411,824 | B2 | 4/2013 | Bucchieri |
| 8,624,810 | B2 | 1/2014 | Ahn |
| 2002/0010694 | A1 | 1/2002 | Navab |
| 2006/0174315 | A1 | 8/2006 | Kim |
| 2010/0208041 | A1 | 8/2010 | Savvateev |

(Continued)

FOREIGN PATENT DOCUMENTS

| | | |
|---|---|---|
| CN | 102376200 | 3/2012 |
| EP | 2584403 | 4/2013 |

(Continued)

OTHER PUBLICATIONS

Alexandridis, "Forthroid on Android: A QR-code based Information Access System for Smart Phones," 18th IEEE Workshop on Local and Metropolitan Area Networks (LANMAN), Oct. 2011, 6 pages.

(Continued)

*Primary Examiner* — Kimnhung Nguyen

(57) ABSTRACT

A system for augmenting displayed content with embedded invisible information such as visual or audio information, or a network link to the augmented information. The system includes a display module, first and second backlight modules, and a controller. The first and second backlight modules selectively provide visible light and invisible light, such as infrared light, to the display module. The controller provides first and second frames of content, alternating in a time sequential manner, to the display module with the first frames of content backlit by the first backlight module and the second frames of content backlit by only the second backlight module. The second frames of content provide invisible information embedded with the first frames of content and can be detected an infrared camera and used to display or provide augmented information.

18 Claims, 7 Drawing Sheets

(56) References Cited

U.S. PATENT DOCUMENTS

| | | | | |
|---|---|---|---|---|
| 2011/0090253 | A1 | 4/2011 | Good | |
| 2011/0128384 | A1 | 6/2011 | Tiscareno | |
| 2012/0081412 | A1 | 4/2012 | Kim | |
| 2012/0176491 | A1 | 7/2012 | Garin | |
| 2012/0330646 | A1 | 12/2012 | Andrade | |
| 2013/0041610 | A1 | 2/2013 | Waters | |
| 2013/0160048 | A1 | 6/2013 | Cho | |
| 2014/0267466 | A1* | 9/2014 | Takagi | G09G 3/36 345/691 |
| 2015/0009169 | A1* | 1/2015 | Lee | G06F 3/0416 345/174 |

FOREIGN PATENT DOCUMENTS

| | | |
|---|---|---|
| JP | 09185330 | 7/1997 |
| JP | 2009258893 | 11/2009 |
| KR | 20130017773 | 2/2013 |
| KR | 20130058146 | 6/2013 |
| WO | WO 2011-156792 | 12/2011 |

OTHER PUBLICATIONS

"Artoolkit," [retrieved from the internet on Apr. 4, 2014], URL <http://www.hitl.washington.edu/artoolkit/>, 1 page.

Baus, "A Resource-Adaptive Mobile Navigation System", Proceedings of the 7th international conference on Intelligent User Interface; IUI' 02, Jan. 13-16, 2002, pp. 15-22.

Chiou, An IMU-Based Positioning System Using QR-Code Assisting for Indoor Navigation, Computer Science and its Applications, Lecture Notes in Electrical Engineering 655-665 (2012).

"Color filters for LCDs", Toppan Printing Co. Ltd., pp. 9-10 (undated).

United Nations General Assembly Promotion and protection of human rights, 61st Session, 67 (b), Dec. 6, 2006, 33 pages.

Fallah, "Indoor Human Navigation Systems—a Survey", Interacting with Computers, Sep. 26, 2012, vol. 25, 28 pages.

Feng, "Augmented Reality Markers as Spatial Indices for Indoor Mobile AECFM Applications," 12th International Conference on Construction Application of Virtual Reality, Nov. 1-2, 2012, pp. 235-242.

Gu "A Survey of Indoor Positioning Systems for Wireless Personal Networks", IEEE Communications Surveys & Tutorials, First Quarter 2009, vol. 11, No. 1, pp. 13-32.

Haruyama, "Visible Light Communications: Recent Activities in Japan", Keio University, Feb. 8, 2011, 49 pages.

Kyle, Sign on Television: Analysis of Data Based on Projects carried out by the Deaf Studies Trust 1993-2005, Jul. 2007, 13 pages.

Smith, "Why subtitles aren't always enough", The Guardian, Film Blog, [online], presented on Nov. 28, 2008, [retrieved from the internet on Jul. 31, 2013] UR <http://www.guardian.co.uk/film/filmblog/2008/nov/28/deaf-subtitles-sign-language-film>, , 4 pages.

Ishida, "An Architecture for High-speed Parallel Wireless Visible Light Communication System using 2D Image Sensor and LED Transmitter", Proceedings of International Symposium on Wireless Personal Multimedia Communications (WPMC' 05),Sep. 18-22, 2005, pp. 1523-1527.

Kalkusch, "Structured Visual Markers for Indoor Pathfinding", Proceedings of IEEE 1st Int. Workshop on Augmented Reality Toolkit, Technical Report TR-188-2-2002-13, Vienna University of Technology, 2002, pp. 1-8.

Lee, "Color filter patterned by screen printing", Thin Solid Films, 2008, vol. 516, No. 21, pp. 7875-7880.

Lee, "Hybrid Infrared and Visible Light Projection for Location Tracking," USIT '07 Proceedings of the 20th annual ACM symposium on User interface software and technology, 2007, pp. 57-60.

Li, "A Reliable and Accurate Indoor Localization Method Using Phone Inertial Sensors", UbiComp '12 Proceedings of the 2012, ACM Conference on Ubiquitous Computing, 2012, pp. 421-430.

De Lpina, TRIP: a Low-Cost Vision-Based Location System for Ubiquitous Computing, Personal and Ubiquitous Computing, May 2002, vol. 6, No. 3, pp. 1-12.

Lu, "Designing color filter arrays for the joint capture of visible and near-infrared Images", 16th IEEE International Conference on Image Processing, Nov. 2009, pp. 3797-3800.

Lukianto, "Overview of Current Indoor Navigation Techniques and Implementation Studies," Alternatives and Backups to GNSS, FIG Working Week, 2011, pp. 1-14.

Lyardet, "Context-Aware Indoor Navigation," Ambient Intelligence, 290-307 (2008).

Maeda, "Tracking of User Position and Orientation by Stereo Measurement of Infrared Markers and Orientation Sensing," 8th International Symposium on Wearable Computer, ISWC 2004, Oct. 2004, vol. 1, pp. 77-84.

Mulloni, "Indoor Positioning and Navigation with Camera Phones," Pervasive Computing, IEEE Computer Society, Apr. 2009, vol. 8, No. 2, pp. 22-31.

Nakazato, "An Initialization Tool for Installing Visual Markers in Wearable Augmented Reality", Advances in Artificial Reality and Tele-Existence—Lecture Notes in Computer Science, Nov. 2006, vol. 4282, pp. 228-238.

Nakazato, "Wearable Augmented Reality System Using Invisible Visual Markers and an IR Camera", 9th IEEE International Symposium on Wearable Computers, 2005, pp. 198-199.

Xiao, "Sign Language interpreting on Chinese TV; a survey on user perspectives", Perspectives Studies in Translattology, 2013, vol. 21, No. 1, pp. 43.

"Signlangtv.org," All TV Shows, [retrieved from the internet on Jul. 31, 2013] URL <http://signlangtv.org/www/all-tv-shows.php>, 3 pages.

ASL & English Resources for Interpreting in Medical Settings, St. Catherine University, <http://www.medicalinterpreting.org/Interpreting/CDROMS/Heart.html>, 2006, 2 pages.

Sun, "Polaris: Getting Accurate Indoor Orientations for Mobile Devices Using Ubiquitous Visual Patterns on Ceilings", Hotmobile '12, Feb. 28-29, 2012, 6 pages.

Susstrunk, "Invited Paper: Enhancing the Visible with Invisible: Exploiting Near-Infrared to Advance Computational Photography and Computer Vision", SID Symposium Digest of Technical papers, May 2010, vol. 41, No. 1, pp. 90-93.

Wang, "Unsupervised Indoor Localization", Mobisys '12, Jun. 25-29, 2012, pp. 197-210.

Yamamiya, "Using Infrared-Transparent Pigments to Identify Objects", Systems and Computers in Japan, 2002, vol. 33, No. 10, pp. 74-82.

Zhang, "Enhancing Photographs with Near Infrared Images", Proceedings of. IEEE Computer Society Conference Computer Vision and Pattern Recognition, 2008, International Conference on Computer Vision and Pattern Recognition, Jun. 2008, 8 pages.

PCT International Search Report for PCT/US2015/018382, mailed Jun. 4, 2015.

* cited by examiner

AUGMENTED INFORMATION DISPLAY

BACKGROUND

Visible light communication has received attention recently due to the growing application of solid state lighting devices, which makes them candidates for ubiquitous communication vehicles. On the other hand, the ubiquitous visual display devices, such as television and digital signage, are only communicative in the traditional sense by conveying visual imagery. Increasingly, these displays are adding other data or information overlaid on the main video content, such as Quick Response (QR) codes in addition to traditional overlaid information such as scrolling information bars. All of this additional data can be intrusive and space-consuming when combined with the video content. Accordingly, a need exists for ways to convey information via an electronic display in addition to displayed video or other content.

SUMMARY

A system for augmenting displayed content, consistent with the present invention, includes a display module, first and second backlight modules, and a controller. The first backlight module provides visible light to the display module, and the second backlight module provides only invisible light to the display module. The controller provides first and second frames of content to the display module in a time sequential manner with the first frames of content backlit by the first backlight module and the second frames of content backlit by only the second backlight module.

A method for augmenting displayed content, consistent with the present invention, includes providing to a display module first frames of content backlit by a first backlight module, providing to the display module second frames of content backlit by only a second backlight module, and alternating the first and second frames of content provided to the display module in a time sequential manner. The first backlight module provides visible light to the display module, and the second backlight module provides only invisible light to the display module.

A first method for receiving augmented displayed content, consistent with the present invention, includes receiving first frames of visible content from a display module, receiving second frames of only invisible content from the display module and alternating with the first frames in a time sequential manner, and displaying the first frames of visible content. Information is retrieved based upon the second frames of invisible content, and the retrieved information is provided with the first frames of visible content.

A second method for receiving augmented displayed content, consistent with the present invention, includes receiving first frames of visible content from a display module, and receiving second frames of only invisible content from the display module and alternating with the first frames of visible content in a time sequential manner. The method also includes receiving a selection relating to the first and second frames of content and displaying, based upon the selection, either the first frames of visible content or the second frames of invisible content as visible content.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Embodiments of the present invention use field sequential backlights to implement temporal and spectral multiplex transmissions of invisible information, for example infrared, and visible information through an LCD module or other type of backlit display. The visible information, such as color video or images (RGB images), are displayed by the LCD module. The invisible information, encoded as infrared information for example, is provided by the LCD module by being backlit by only an infrared backlight. The visible and invisible information are provided in frames of content, alternating in a time sequential manner. While the invisible information is not visible to a viewer of the LCD module, the invisible information can be detected by an infrared camera, or other sensor, and used to augment the visible information. For example, the invisible information can include a link used to retrieve visual content to be displayed overlaid or along with the visible information, or a link to retrieve audio content to be provided along with the visible information. In this manner, the same display can be used to provide augmented information along with visible information.

Figure 1:
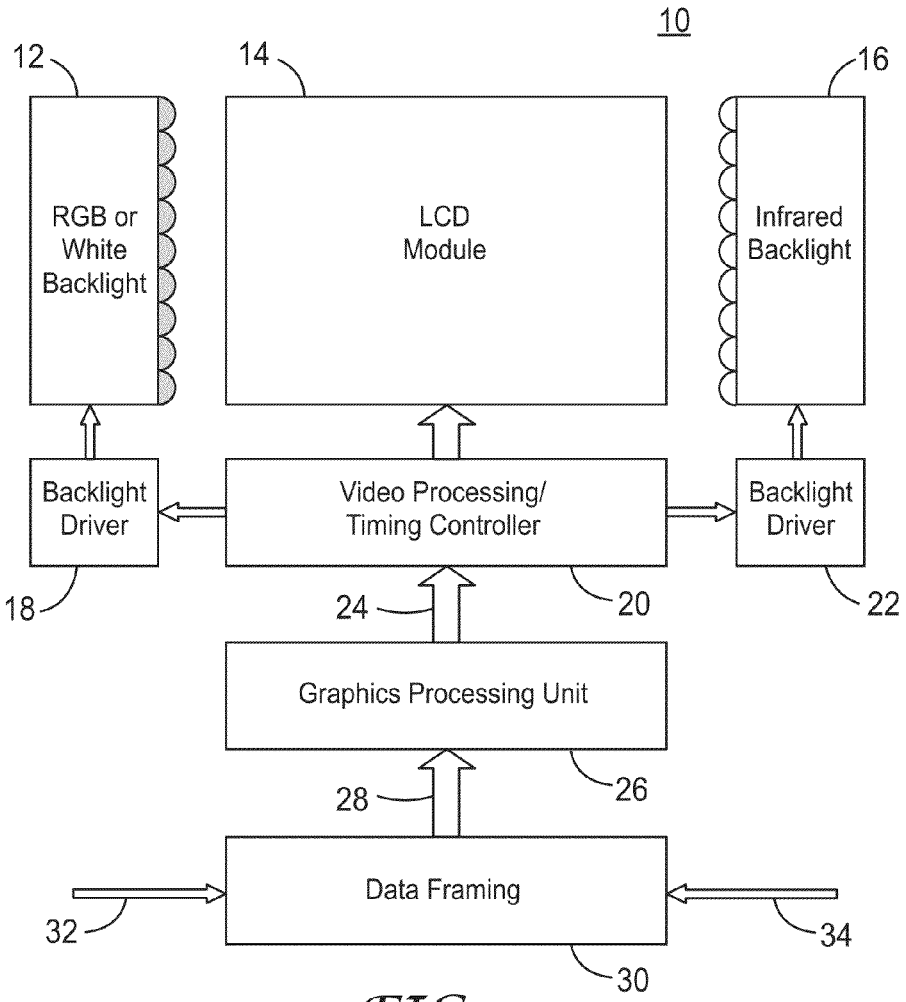
FIG. 1 is a block diagram of an augmented information display system.

FIG. 1 is a block diagram of an augmented information display system 10. System 10 includes an LCD module 14, a red-green-blue (RGB) or white backlight 12 driven by a backlight driver 18, and an infrared backlight 16 driven by a backlight driver 22. A video processing and timing controller 20 provides content to LCD module 14 and controls switching of backlights 12 and 16 via drivers 18 and 22. A data framing unit 30 receives visible information from source 32 and invisible information from source 34, and data framing unit 30 provides on connection 28 odd frames as RGB visible data from source 32 and even frames as invisible data (for example, infrared data mapped to the red component of the display) from source 34. A graphics processing unit 26 receives the odd and even frames, and provides video data with corresponding timing signals (for example at 120 Hz or higher) on connection 24 to video processing and timing controller 20. The odd and even frames are provided to LCD module 14 by processing and timing controller 20, which uses the associated timing signals to control switching of backlights 12 and 16 while the frames are provided to LCD module 14.

Figure 2:
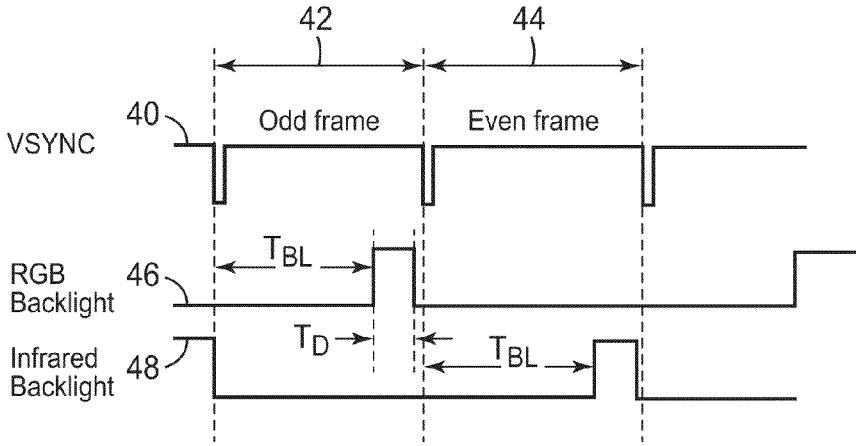
FIG. 2 is a timing diagram of backlight drivers for an augmented information display system.

FIG. 2 is a timing diagram of backlight drivers for augmented information display system 10. A video synchronization signal (VSYNC) illustrated by line 40 controls transmission of the odd frames during time period 42 and even frames during time period 44. An RGB backlight signal illustrated by line 46 controls the switching, turning on and off, of RGB backlight 12 via driver 18, and an infrared backlight signal illustrated by line 48 controls the switching, turning on and off, of infrared backlight 16 via driver 22. The backlight timing signals time sequentially repeat with the VSYNC signal. The $T_{BL}$ period of backlight signals 46 and 48 needs to occur after frame writing plus the panel response time of LCD module 14. The $T_D$ period of backlight signals 46 and 48 can be adjusted for optimal brightness and power consumption of LCD module 14.

The timing diagram illustrates switching of the backlights such that the odd frames (visible information) are only backlit by the RGB backlight, and the even frames (invisible information) are only backlit by the infrared backlit. Alternatively, since the infrared backlight emits light not within the visible spectrum, the infrared backlight can optionally be left on while the odd frames (visible information) are backlit by the RGB backlight with the RGB backlit being switched off while the even frames (invisible information) are backlit by the infrared backlight. The odd and even frames are switched at a sufficiently high rate such that the switching is not visibly perceptible to a viewer of the displayed visual content. The visible and invisible information are referred to as odd and even frames, respectively, for reference purposes only, and the visible information can be in even frames with the invisible information in odd frames, or the visible and invisible information can be within frames referred to as left and right frames. The term "frame" means a full frame of odd and even information or content for a particular display or any partial frame of the data on the display.

Visible information or content means information or content within the visible spectrum of light, and invisible information or content means information or content not within the visible spectrum of light. The visible and invisible frames are provided to the LCD module in a temporal manner, meaning one or more visible frames alternate with one or more invisible frames in a time sequential manner. For example, one invisible frame can alternate with one visible frame to provide the augmented information as a monochromatic image or video. Alternatively, three invisible frames corresponding with the red-green-blue components of the augmented information can alternate with one visible frame to reconstruct and provide the augmented information as a color image or video.

Figure 3A:
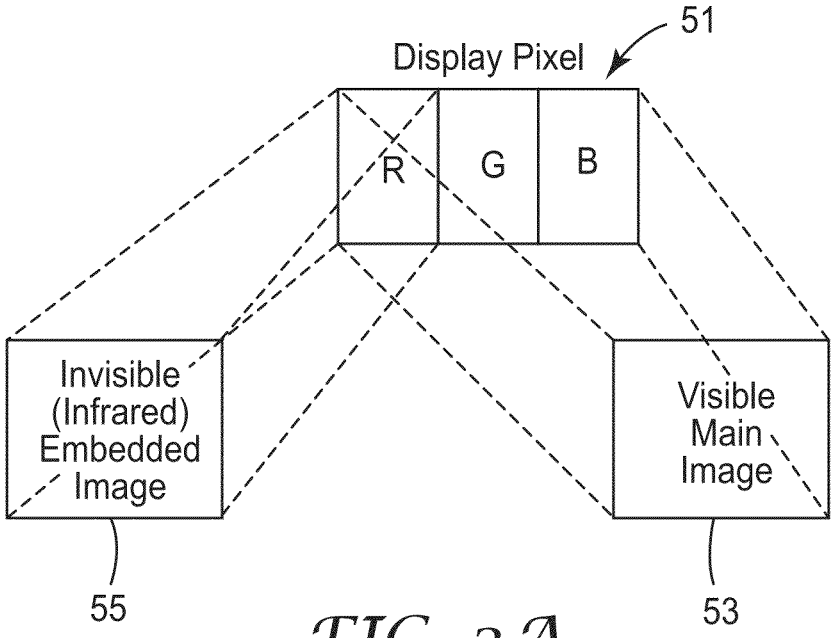
FIG. 3A illustrates transmitting invisible information or content through the red sub-pixels within a liquid crystal display (LCD) module.

The backlights can be implemented with, for example, an edge-lit backlight having an RGB light source on one edge and the infrared light source on an opposing edge, or with a hybrid backlight having both RGB and infrared light sources together with the RGB and infrared light sources separately controlled by a backlight driver. Alternatively, the backlights can be any backlight capable of separately providing visible light and infrared (or other invisible) light. The RGB backlight can use, for example, red, green, and blue LEDs to provide a white backlight. The infrared backlight can use, for example, LEDs emitting infrared light and not emitting light within the visible spectrum. When an infrared backlight is used to provide the invisible information or content, the invisible information or content is primarily transmitted through the red sub-pixel (red color filter) within the LCD module, as illustrated in FIG. 3A. A typical display pixel 51 for a backlit display module has red (R), green (G), and blue (B) color filters corresponding with the red, green, and blue sub-pixels to render desired color through the combination of the three primary colors. A visible main image 53 is transmitted through one or more of the RGB sub-pixels, depending upon the content of the visual image. An invisible (infrared) embedded image 55 is transmitted through the red sub-pixel using the infrared backlight.

More particularly, in typical LCD devices the red color filters have high transmittance in the near infrared spectral region and, as a result, data-modulated infrared light can pass through the red filter. Augmented information can thus be encoded with only the red component while maintaining both the green and blue components at constant level (for example zero), since any infrared light information carried by green and blue sub-pixels is blocked by their corresponding band-pass color filters.

One factor for encoding augmented information is the wavelength of the infrared LED, which can determine the optical characteristics of the infrared illuminated imagery through the light modulator portion of the LCD panel stack-up, including a pair of crossed linear polarizers and a layer of liquid crystal molecules. Although it is possible to devise components to match a particular wavelength, it is preferred that the wavelength is selected to work with LCD components, or other backlit displays, designed to work with visible light. Based upon the spectral absorption of an OCB (optically compensated bend) and a TN (twisted nematic) LCD panel, the wavelength range of 720 nm-760 nm provides a reasonable balance between good contrast ratio of infrared content and good rejection of visible light. Also, there is strong dioxygen ($O_2$) absorption of solar radiance at 760 nm, which can help to reduce the interference from daylight in outdoor applications.

Figure 3B:
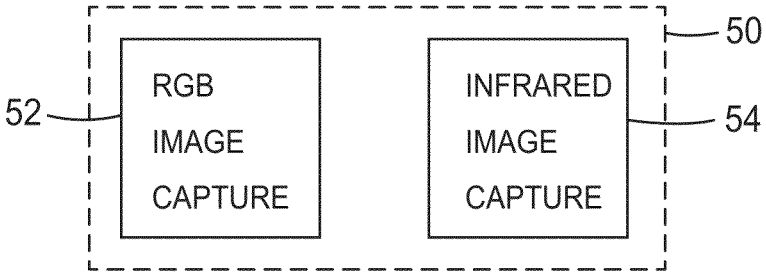
FIG. 3B shows user interfaces illustrating content for an augmented information display system.

FIG. 3B shows user interfaces illustrating content for augmented information display system 10. Information or content 50 provided by LCD module 14 includes an RGB image capture 52 and an infrared image capture 54. RGB image capture 52 corresponds with visible content displayed by LCD module 14 from the visible (odd) frames backlit by RGB backlight 12, and infrared image capture 54 corresponds with invisible content provided by LCD module 14 from the invisible (even) frames backlit by infrared backlight module 16. Infrared image capture 54 can be detected from LCD module 14 by an infrared camera or other infrared sensor. For example, a mobile phone or device, such as a smart phone, can have an infrared camera to detect the invisible information, or the device can use an RGB camera without an infrared filter to detect both visible and invisible information.

The augmented information in the invisible frames can include visual content such as images, video, or textual information, and metadata or links to information. The links can include, for example, a network address such as uniform resource locator (URL) or other network identifier used to electronically access remote information or content, for example content on a server accessed by a processor-based device via a network such as the Internet or other computer-based network. These links can be represented by, for example, codes such as a QR code or other indicia capable of being detected by an infrared camera or other sensor for obtaining the provided invisible information.

Figure 4:
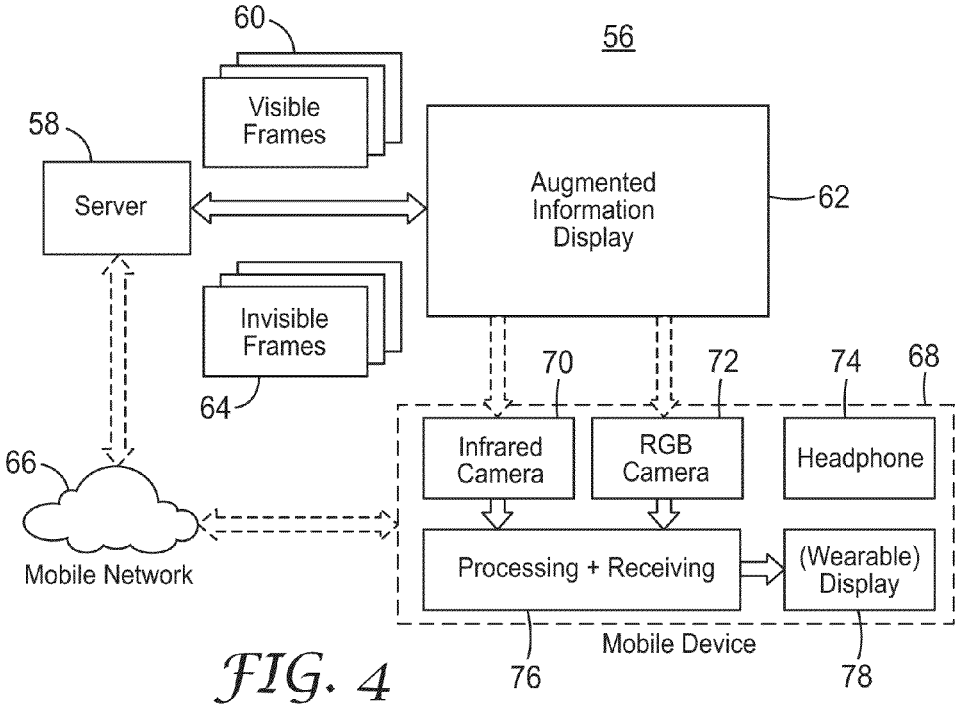
FIG. 4 is a block diagram of an augmented information display guide system.

FIG. 4 is a block diagram of an augmented information display guide system 56. System 56 includes an augmented information display 62, which corresponds with system 10 and receives visible frames of content 60 and invisible frames of content 64 from a server 58. Augmented information display 62 can display visible frames of content 60 backlit by an RGB backlight and provide invisible frames of content 64 via an infrared backlight. A mobile device 68, such a smart phone, includes an RGB (color) camera 72 to capture the visible content displayed by augmented information display 62 and an infrared camera 70 to detect the invisible content provided by display 62. A processing and receiving unit 76 provides the visible content to a display 78, such as a display on mobile device 68 or an optional wearable display. Using the detected invisible content, processing and receiving unit 76 retrieves augmented content from server 58 via a mobile network 66 and provides the augmented information to display 78 for augmented visual information or to a headphone or speaker 74 for augmented audio information.

Figure 5:
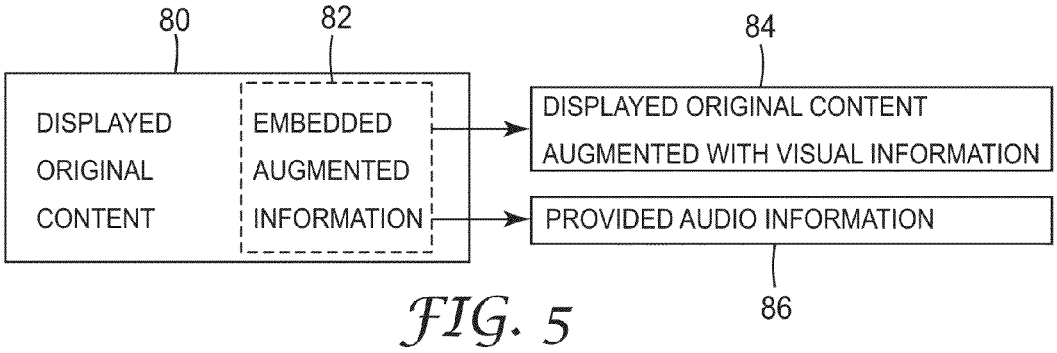
FIG. 5 shows user interfaces illustrating content for an augmented information display guide system.

FIG. 5 shows user interfaces illustrating content for augmented information display guide system 56. Displayed original content 80 on augmented information display 62 includes embedded augmented information 82, such as infrared or other invisible information. Mobile device 68 can display the original content augmented with visual information 84 on display 78 or provide the augmented audio information 86 via headphone or speaker 74.

The augmented information can include descriptive metadata or links embedded as invisible information along with visual information. For example, the augmented data can include a menu, or link to a menu, embedded within a digital sign and to be displayed on a user's mobile device. When the main content is digital signage or advertising displaying electronic images or video, the augmented embedded information can include information related to the displayed information or to the advertised products or services. For example, the augmented embedded information in the digital signage can include a QR code with a link to a digital coupon or other information. As another example, the augmented embedded information can include the text displayed on the digital signage translated into another language. When the augmented embedded information includes a link to audio information, the audio can be used as an audio guide within a museum, for example, or other facility.

Figure 6:
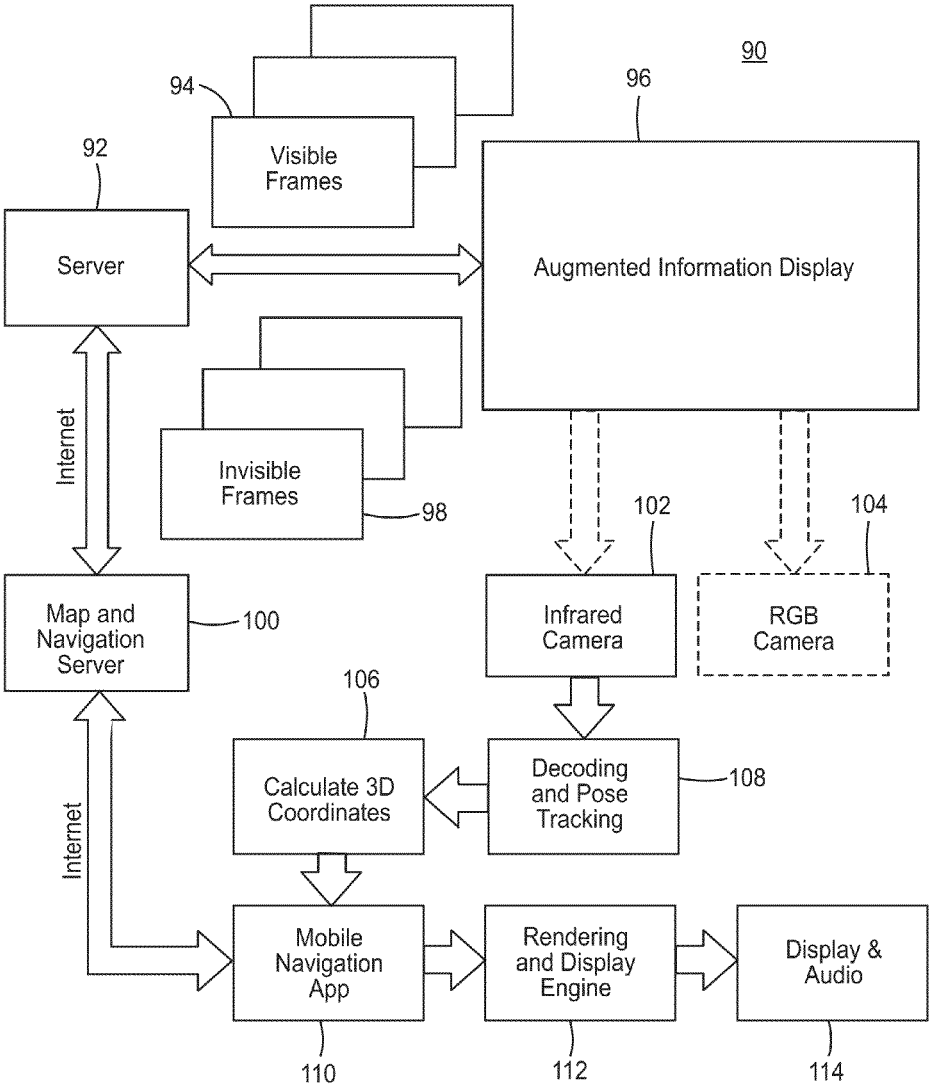
FIG. 6 is a block diagram of an augmented information display positioning and navigation system.

FIG. 6 is a block diagram of an augmented information display positioning and navigation system 90. System 90 includes an augmented information display 96, which corresponds with system 10 and receives visible frames of content 94 and invisible frames of content 98 from a server 92. Augmented information display 96 can display visible frames of content 94 backlit by an RGB backlight and provide invisible frames of content 98 via an infrared backlight. A mobile device, such as a smart phone, includes an RGB camera 104 to capture the visible content displayed by augmented information display 96 and an infrared camera 102 to detect the invisible content provided by display 96. A decoding and pose tracking unit 108 receives the detected invisible content and provides it to a unit 106 to calculate 3D coordinates of the position of the mobile device containing infrared camera 102 from the detected invisible content. A mobile navigation application 110, receiving and using the 3D coordinates, can access a map and navigation server 100 to obtain augmented navigational information based upon the 3D coordinates. Mobile navigation application 110 provides the augmented navigational information to a rendering and display engine 112, which displays the visual content augmented with displayed navigational information such as on a display device on the user's mobile device.

Figure 7:
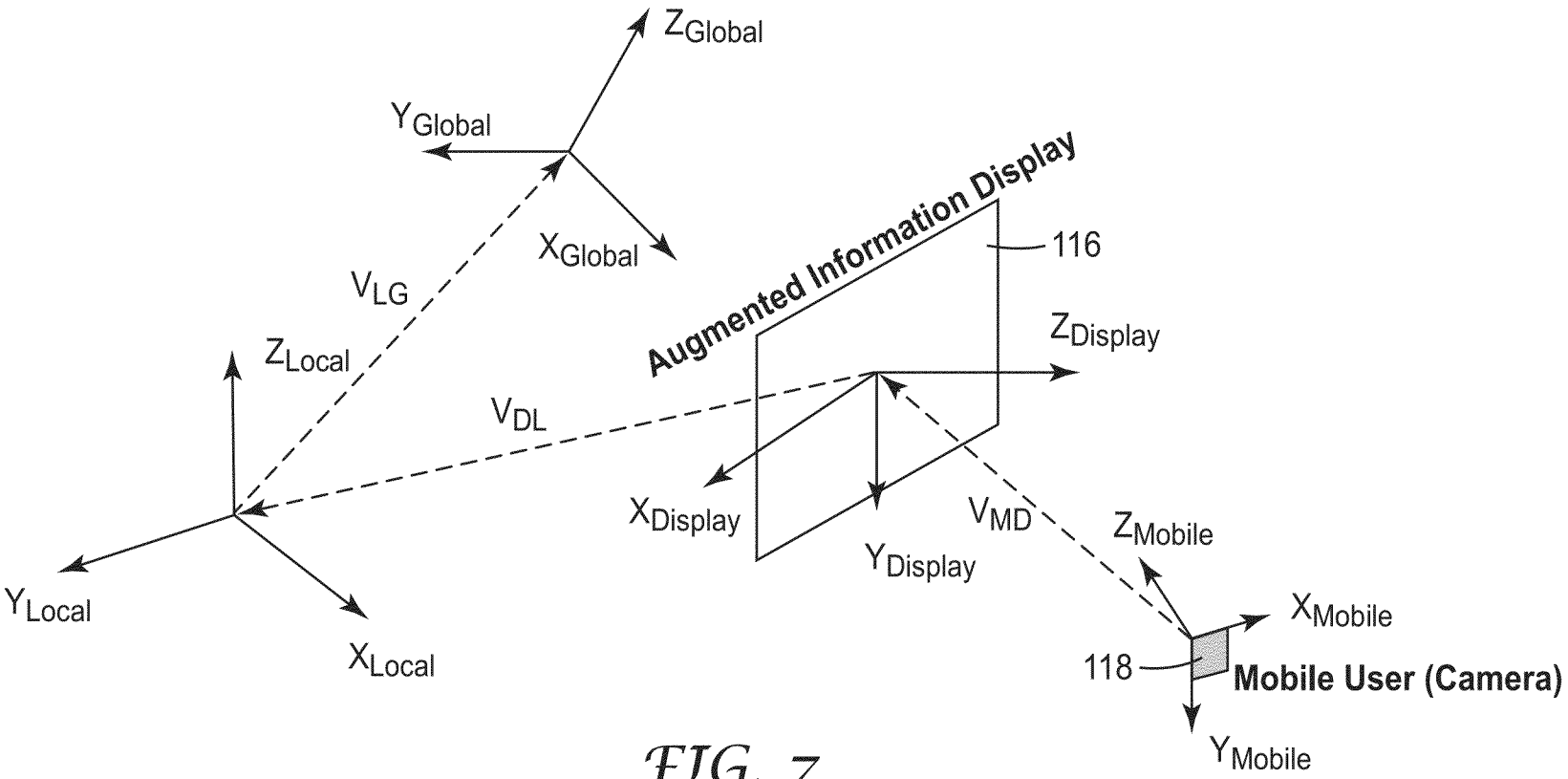
FIG. 7 is a diagram illustrating three-dimensional (3D) positioning of a user of an augmented information display positioning and navigation system.

FIG. 7 is a diagram illustrating 3D positioning of a user of augmented information display and positioning and navigation system 90. An augmented information display 116 corresponds with display 96, and a user having a mobile device 118 is located within the vicinity of augmented information display 116 to provide augmented navigational information to the user. Augmented information display 116 is located at a position having coordinates $X_{Display}$, $Y_{Display}$, $Z_{Display}$, which are known coordinates. The system can also make use of global and local positioning systems, having known coordinates $X_{Global}$, $Y_{Global}$, $Z_{Global}$ for the global system and $X_{Local}$, $Y_{Local}$, $Z_{Local}$ for the local system. The vectors $V_{LG}$ and $V_{DL}$ represent the positions of the local coordinate system with respect to the global system and the location of augmented information display 116. The global system can correspond with, for example, the Global Positioning System (GPS), and the local positioning system can correspond with known positions within an indoor space. A position of augmented information display system 116 to mobile device 118 is represented by the vector $V_{MD}$.

The user's mobile device has coordinates $X_{Mobile}$, $Y_{Mobile}$, $Z_{Mobile}$. Augmented information display 116 provides embedded invisible positional information as a two-dimensional (2D) codes or markers, for example. Mobile device 118 can detect these codes using an infrared camera, for example, to determine the location of augmented information display 116. Once the 3D position vector of the camera in mobile device 118 relative to augmented information display 116 ($PD_{camera}$) is obtained, the 3D position of the camera in the local coordinate system ($PL_{camera}$), for example within a building, can be calculated based upon the position of augmented information display 116 ($PL_{Display}$) and the position of the camera ($PD_{camera}$) according to the calculation $PL_{Camera}=PL_{Display}+PD_{Camera}$.

When a local or server-based map of a local environment is available, the position $PL_{Camera}$ can be used to position the mobile user within the map or be used as the calibration reference for further navigation. Optionally, the global position of the camera, for example using GPS, can also be calculated and used in the navigation. An example of a software application for determining pose estimation data of a camera based upon a captured fiduciary marker is the ARToolKit for use in developing augmented reality (AR) applications from ARToolworks, Inc. The invisible positional information provided by augmented information display 116 can include such a fiduciary marker.

Augmented information display and positioning and navigation system 90 can provide a way to embed navigational (or positioning) markers for marker-based indoor positioning and navigation, for example in locations where GPS does not work well. The invisible navigational information is used as a dynamic 2D marker capable of being electronically changed to indicate different positions. With augmented information display 116 having a known location, the invisible embedded markers can be used to calculate the relative position and angle (orientation) of the mobile device decoding the marker and provide, for example, information to the user for navigating an indoor space such as a shopping mall. The term "navigational information" means information relating to a user's position, and optionally orientation, relative to an augmented information display. The user's position is considered to be a position of a mobile device, or other device, detecting the invisible navigational information provided by the augmented information display.

Figure 8:
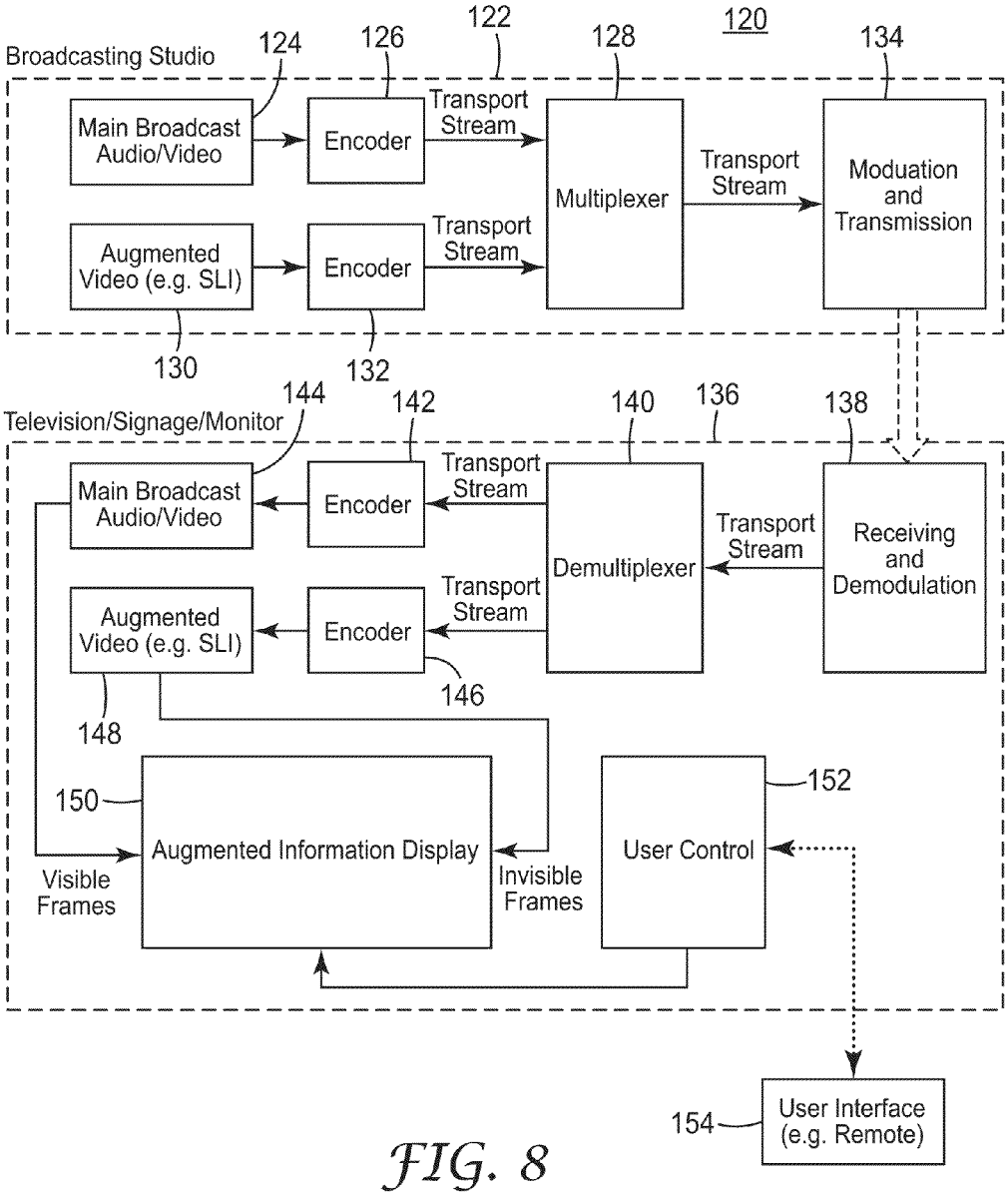
FIG. 8 is a block diagram of an augmented information display communication aid system.

FIG. 8 is a block diagram of an augmented information display communication aid system 120. System 120 includes a broadcasting system 122 to generate content for augmented communication and a system 136 to deliver the main and augmented content. System 122 includes main audio/video content 124 and augmented video content 130. Main content 124 and augmented content 130 are transmitted by encoders 126 and 132, respectively, to a multiplexer 128, which combines the content, for example as alternating time sequential frames of content. A modulation and transmission module 134 transmits the combined main content and augmented content.

System 136 includes a receiving and demodulation module 138 for receiving the transmitted combined content. A demultiplexer 140 separates the main content from the augmented content to provide main broadcast audio/video content 144 via an encoder 142 and augmented video content 148 via an encoder 146. An augmented information display system 150, which corresponds with system 10, displays main broadcast audio/video content 144 as visible frames and provides augmented video content 148 as invisible frames. A user interface 154 or other remote control device can allow a user via a user control module 152 to view the main broadcast audio/video content or the augmented video content.

Figure 9:
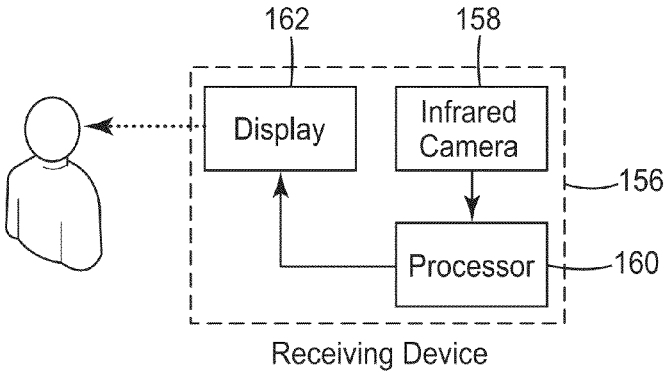
FIG. 9 is a block diagram of a receiving device for providing information via an augmented information display communication aid system.

FIG. 9 is a block diagram of a receiving device 156 for providing information via augmented information display communication aid system 120. Device 156, such as a mobile device or smart phone, includes an infrared camera 158 for detecting the augmented video content in the invisible frames from augmented information display 150 and a processor 160 for controlling display of the augmented content as visible information on a display 162. In particular, the invisible information, once retrieved, can be displayed as visible content by displaying the content on an LCD module backlit by an RGB or white backlight.

Figure 10:
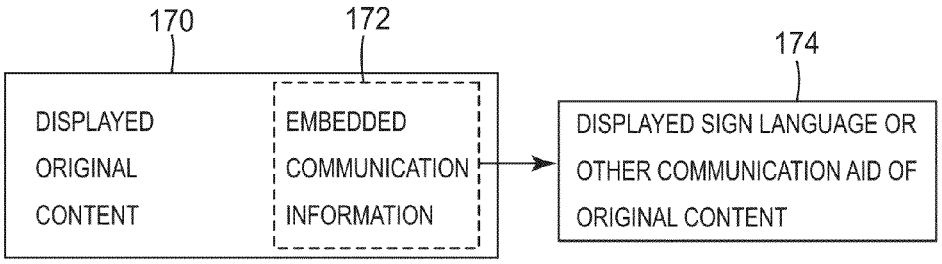
FIG. 10 shows a user interface for providing information via an augmented information display communication aid system.

FIG. 10 shows a user interface for providing information via augmented information display communication aid system 120. Displayed main audio/video content 170 on augmented information display 150 includes embedded augmented communication information 172, such as infrared or other invisible information providing a communication aid. Receiving device 156 can display the invisible embedded communication information as visual sign language or other communication aid 174 of the main content as indicated with respect to FIG. 9.

Examples of communication aid information include sign language videos, subtitles shown as textual information, and audio information. Users desiring to receive the augmented communication information can have their own displays separate from the augmented information display providing the main content, instead of or in addition to overlaying sign language or subtitles on the displayed main content. The embedded augmented communication information can include a database of links to sign language videos for phrases displayed on the augmented information display, as represented in Table 1. The subtitles can include textual information in a variety of language relating to the displayed main content. The augmented audio information can be used, for example, in a setting where individual viewers of the displayed main content can receive the audio content associated with the main content without broadcasting the audio content to the entire audience.

TABLE 1

| | | |
|---|---|---|
| video 1 | link 1 | sign language video 1 |
| video 2 | link 2 | sign language video 2 |
| . . . | . . . | . . . |
| video N | link N | sign language video N |

The invention claimed is:

1. A system for augmenting displayed content, comprising:
a display module having red, green, and blue sub-pixels;
a first backlight module for providing visible light to the display module;
a second backlight module for providing only invisible light to the display module;
a controller, coupled to the display module and the first and second backlight modules, for providing first frames of content and second frames of content to the display module with the first and second frames of content alternating in a time sequential manner,
wherein the first frames of content are backlit by the first backlight module, the second frames of content are primarily backlit by the second backlight module, and the second frames of content are primarily transmitted through the red sub-pixels;
an infrared camera that captures the second frames of content; and
a processing unit, coupled to the infrared camera, that uses the captured second frames of content to provide information related to the first frames of content.

2. The system of claim 1, wherein the first backlight module comprises a red, green, and blue LED backlight module.

3. The system of claim 1, wherein the second backlight module comprises an infrared backlight module.

4. The system of claim 1, wherein the second frames of content comprise a link to visual video information.

5. The system of claim 1, wherein the second frames of content comprise a link to audio information.

6. The system of claim 1, wherein the second frames of content comprise a link to navigational information.

7. The system of claim 1, wherein the second frames of content comprise sign language information relating to the first frames of content.

8. The system of claim 1, wherein the second frames of content comprise textual language information relating to the first frames of content.

9. A method for augmenting displayed content, comprising:
providing to a display module, having red, green, and blue sub-pixels, first frames of content backlit by a first backlight module;
providing to the display module second frames of content primarily backlit by a second backlight module;
alternating the first and second frames of content provided to the display module in a time sequential manner,
wherein the first backlight module provides visible light to the display module, and the second backlight module provides only invisible light to the display module;
primarily transmitting the second frames of content through the red sub-pixels;
capturing the second frames of content using an infrared camera; and
using the captured second frames of content to provide information related to the first frames of content.

10. The method of claim 9, wherein the providing steps comprise:
providing the first frames of content backlit by a red, green, and blue LED backlight module; and
providing the second frames of content backlit by an infrared backlight module.

11. The method of claim 9, wherein the providing the second frames of content step comprises providing a link to visual information.

12. The method of claim 9, wherein the providing the second frames of content step comprises providing a link to audio information.

13. The method of claim 9, wherein the providing the second frames of content step comprises providing a link to navigational information.

14. The method of claim 9, wherein the providing the second frames of content step comprises providing sign language information relating to the first frames of content.

15. The method of claim 9, wherein the providing the second frames of content step comprises providing textual language information relating to the first frames of content.

16. The method of claim 9, wherein the using step comprises displaying visual information.

17. The method of claim 9, wherein the using step comprises providing audio information.

18. The method of claim 9, further comprising receiving a selection relating to the first frames of content and the second frames of content, and wherein the using step comprises displaying, based upon the selection, either the first frames of content or the second frames of content as visible content.

* * * * *